United States Patent [19]

Hament

[11] 4,420,111

[45] Dec. 13, 1983

[54] CUP AND COVER COMBINATION

[76] Inventor: Erwin Hament, 53-22 Roosevelt Ave., Woodside, N.Y. 11377

[21] Appl. No.: 402,224

[22] Filed: Jul. 27, 1982

[51] Int. Cl.[3] ..... B65D 41/26; B65D 47/04

[52] U.S. Cl. ..... 229/7 SC; 220/90.4; 220/339; 220/351; 222/559; 229/1.5 B; 229/7 R

[58] Field of Search ..... 222/480, 561, 559; 220/345, 351, 337, 339, 90.2, 90.4; 229/1.5 B, 7 R, 43, 19, 20, 75 C, 11, 17 SC

[56] References Cited

U.S. PATENT DOCUMENTS

| | | | |
|---|---|---|---|
| 2,102,094 | 12/1937 | Romig | 220/351 |
| 2,273,998 | 2/1942 | Rueger | 222/480 |
| 2,289,747 | 7/1942 | Baker | 222/480 |
| 2,355,062 | 8/1944 | Erb et al. | 222/480 |
| 2,801,040 | 7/1957 | Meyer-Jagenberg et al. | 229/7 SC |
| 2,815,161 | 12/1957 | Kramer | 220/345 X |
| 2,846,130 | 8/1958 | Foote | 229/7 SC |
| 3,071,306 | 1/1963 | Trethewey | 229/20 |
| 3,137,431 | 6/1964 | Crouse et al. | 229/1.5 B |
| 3,417,897 | 12/1968 | Johnson | 220/339 X |
| 4,190,191 | 2/1980 | Forbes, Jr. | 229/43 |

*Primary Examiner*—Allan N. Shoap

*Attorney, Agent, or Firm*—McAulay, Fields, Fisher, Goldstein & Nissen

[57] ABSTRACT

A drinking cup and cover combination is provided. The cup has a substantially rectangular mouth, walls and an open top extending to the walls. The cover for the cup includes a plurality of downwardly depending lips, which in cooperation with an arcuate lip on the cup allows the cover to be releasably retained on the mouth of the cup and permits sliding movement of the cover parallel to two parallel sides of the cup mouth and between first and second extreme positions. The foregoing structure permits the cover to completely close the mouth of the cup when it is in the first position and to form a pouring aperture at the mouth of the cup when the cover is in the second position.

12 Claims, 11 Drawing Figures

CUP AND COVER COMBINATION

BACKGROUND OF THE INVENTION

The present invention relates to a container for liquids and more specifically to a drinking cup and a cover therefor.

A problem that is frequently encountered when drinking liquids such as coffee or tea from a styrofoam or cardboard cup, is that the liquid tends to inadvertently spill from the cup, especially when the liquid is being drunk while driving in one's car or on a moving conveyance such as a bus or a train.

In the past, covers have been provided for these drinking cups which completely close same to enable one to move from place to place without spilling the contents of the cup, however, the cover must be totally removed each time a sip is to be taken.

Another solution to this problem has been to provide a cutout in the cover of the cup which enables one to sip the coffee or tea without removing the cover. However, while this prevents a great deal of spillage, it still does not prevent spilling due to the constant opening in the cover.

SUMMARY OF THE INVENTION

The main object of the present invention is to provide an improved cup and cover combination wherein the same cover can be used to both completely close the mouth of the cup and to form a pouring aperture at the mouth of the cup when desired.

Another object of the present invention is to enable one to selectively open and close the cover without removing same so as to, for example, permit one to add sugar or cream to one's coffee or tea or to insert a teabag into hot water within the cup.

These and other objects and advantages of the present invention are achieved in accordance with the present invention by the combination of a cup having means forming a substantially rectangular mouth and a cover for the cup comprising means for releasably retaining the cover on the mouth of the cup and for permitting sliding movement of the cover parallel to two parallel sides of the mouth. The cover is movable between first and second extreme positions and the cover has means for completely closing the mouth of the cup when the cover is in the first position and means forming a pouring aperture at the mouth of the cup when the cover is in the second position.

The cover preferably comprises a rectangular intermediate covering section and first and second end sections connected to the sides of the intermediate section which run perpendicular to the direction of sliding movement. The first end section is rectangular and the second end section has a cutout at the periphery thereof, preferably forming a trapezoid. The intermediate and first sections are configured to overlie the mouth of the cup when the cover is in the first position to comprise the means for completely closing the mouth of the cup and the intermediate and second positions are configured to overlie the mouth of the cup when the cover is in the second position to comprise, with the cutout, the means forming the pouring aperture at the mouth of the cup.

The three sections of the cover are substantially planar and are preferably hingedly connected together by scoring or similar means to enable the lifting of the end sections in the first and second positions without lifting the intermediate section.

The cover is preferably composed of an integral member of deformable rigid material such as plastic or cardboard. The plastic may be the conventional plastic polyethylene plastic material conventionally used for covers. The cup is preferably made of cardboard, plastic or styrofoam material and has a widened rim around the edge of the mouth thereof for engaging with retaining means on the cover.

The retaining means preferably comprises a downwardly depending separate lip at each free side of each of the sections of the cover with the exception of the cutout portion of the second section and has an edge which extends inwardly to engage the underside of the rim. For use with a styrofoam cup for example, the retaining means can comprise a slot at each free side of each section again with the exception of the cutout in the second section, where the slot is receptive of a portion of the edge of the mouth of the cup and is configured to engage with a rim at the mouth edge.

These and other features and advantages of the present invention will become clear from the detailed description below of the preferred embodiments of the present invention along with the accompanying drawings, wherein:

DETAILED DESCRIPTION OF THE PREFERRED EMBODIMENTS

Figure 1:
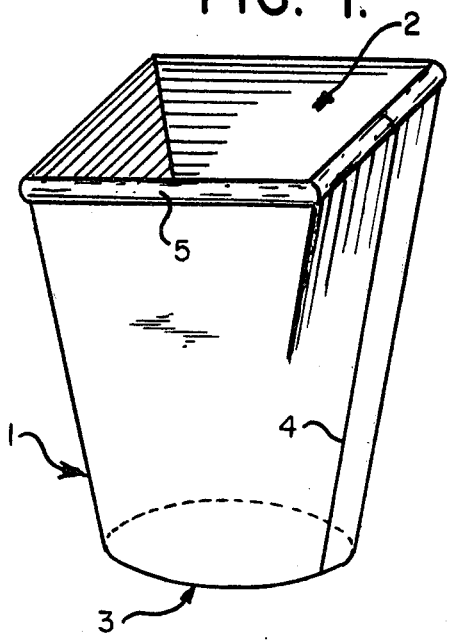
FIG. 1 is a plan view of a cup according to the present invention.
Figure 2:
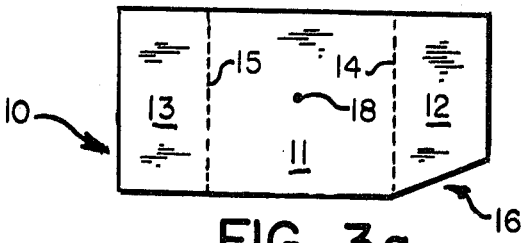
FIG. 2 is a top view of the cover according to the present invention.
Figure 3A:
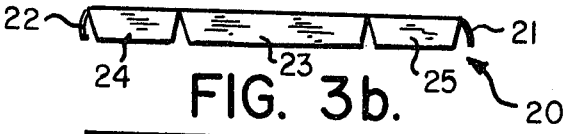
FIGS. 3*a*–3*d* are views of the sides of the cover of FIG. 2.
Figure 3B:
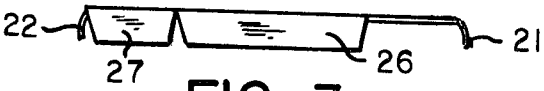
Figure 3C:
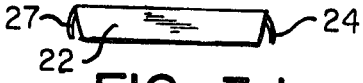
Figure 3D:
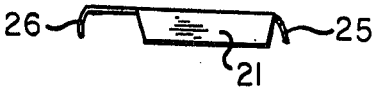

Referring now to FIGS. 1-3, a cup 1 has a substantially rectangular mouth 2 and a circular base 3. When the cup 1 is formed from cardboard or paperboard, the seam 4 is preferably formed centrally of one side thereof. At the mouth 2 of the cup 1 is formed a arcuate lip 5 from the same material forming the cup and integral therewith to give the cup strength and at the same time provide a surface for the releasable engagement of a cover 10 shown in FIGS. 2 and 3.

While the cup 1 may be formed from cardboard and the like, it is also contemplated that styrofoam or plastic cups can be used within the scope of the invention. Moveover, while a round base 3 has been shown, the present invention would be equally operable with a rectangular or oval base cup.

The cover 10 is preferably formed from cardboard or plastic which is relatively rigid but deformable. Conventional plastic material used for cup covers is envisioned as the preferred embodiment for the cover according to the present invention.

The cover 10, preferably formed from a single unitary blank of material, has a rectangular intermediate covering section 11 and two end sections 12 and 13 hingedly connected thereto along lines 14 and 15. The hinged connection is preferably a score line or bend line which enables sections 12 and 13 to bend upwardly or downwardly relative to intermediate section 11.

All three sections 11–13 are the same length while sections 12 and 13 also are configured to have the same width. The combined width of sections 11 and 13 on the one hand and sections 11 and 12 on the other hand are selected so as to substantially overlie the mouth 2 of cup 1 for which it is to be used.

While sections 11 and 13 are rectangular, section 12 has a cutout 16 at one side thereof, forming a right trapazoid configuration in the preferred embodiment. Section 11 also includes an air hole 18 to permit liquid flow and to allow hot air to escape when the cover is closed.

Sections 11–13 also include releasable retaining means 20 for releasably retaining the cover on the mouth 2 of cup 1 while permitting the sliding movement thereof between first and second extreme positions as will be explained hereinafter with respect to FIGS. 4 and 5.

The releasable retaining means, as shown in FIGS. 3*a*–3*d* comprise downwardly depending lips 21–27 which are integrally connected to each of the three sides of sections 11, 12 and 13 with the exception of the vicinity of the cutout 16. Each of the lips 21–27 are separated from each other as shown in FIGS. 3*a*–3*d* in order to enable the pivotal movement of sections 12 and 13 relative to section 11.

Each of the lips 21–27 are slightly arcuate so that the free edge thereof turns inward so as to engage portions of the rim 5 at the mouth of cup 1.

Figure 4:
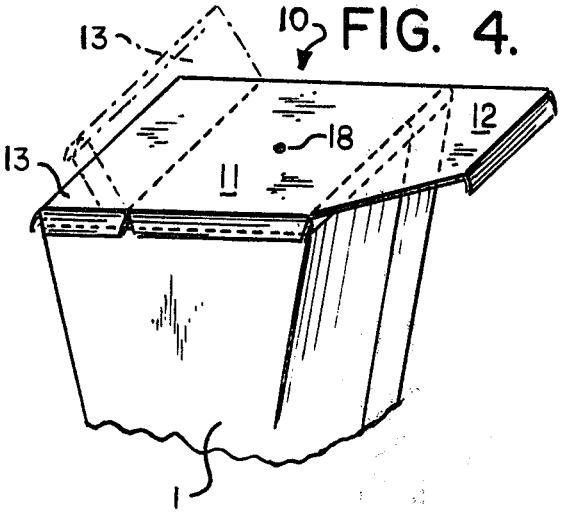
FIG. 4 is a perspective view of the cover on the cup in the first position.
Figure 5:
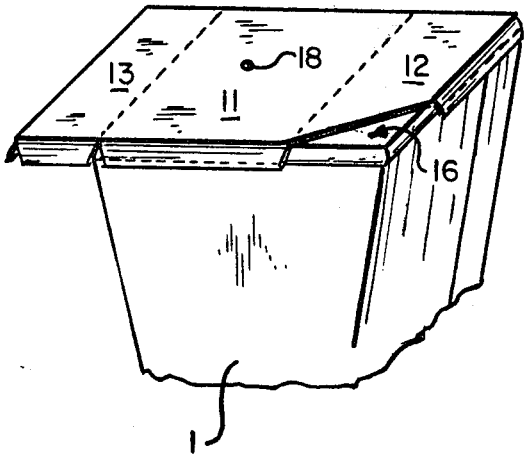
FIG. 5 is a perspective view of the cover on the cup in the second position.

When in place, as shown in FIGS. 4 and 5, the cover 10 can be moved between a first position shown in FIG. 4 wherein the cover completely closes the mouth of the cup and a second position shown in FIG. 5 wherein the cover forms a pouring aperture at the mouth of the cup.

In the position shown in FIG. 4, sections 11 and 13 completely cover the mouth 2 of cup 1 while lips 22–24 and 26–27 engage the rim 5 of the mouth of the cup. In this position, it is contemplated that the user of the cup might want to insert or remove a teabag from the cup, add sugar or cream to one's tea or coffee, while still desiring that the cup remain completely closed thereafter. In this event, the cover 10 according to the present invention allows for section 13 to be hingedly pivoted upwardly to the position shown in dotted lines by disengaging the releasable retaining means thereon from the rim 5 of the cup.

When it is desired to drink from the cup, without removing the cover therefrom, one merely has to slide the cover from the position shown in FIG. 4 to the position shown in FIG. 5 wherein sections 11 and 12 overlie the mouth 2 of the cup 1. In this position, the portions of the releasable retaining means 23 and 26 still remain in engagement with rim 5, while now portions 21 and 25 also engage portions of the rim of the cup. The cutout 16, along with a corner of the mouth of the cup forms a pouring aperture from which the user of the cup can drink the contents thereof while at the same time prevent the inadvertent spilling of the contents of the cup from other portions of the mouth of the cup.

Section 12 is also made hingedly connected to section 11 so as to enable it to be pivoted upwardly in the position shown in FIG. 5 should one desire to add cream or sugar to one's coffee or to insert or remove a teabag without having to slide the cover back into the position shown in FIG. 4. Moreover, the sections 12 and 13 are pivotable so as to enable these sections to be pivoted upwardly or downwardly out of the way when they extend from the side of the cup as shown for section 12 in FIG. 4 and section 13 in FIG. 5 when the cup must be fitted into a limited space or when cups are to be positioned one next to the other on a tray or the like.

Figure 6:
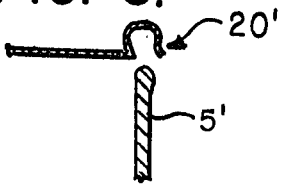
FIG. 6 shows an alternative embodiment of the releasable retaining means for the cover.

Referring now to FIG. 6, it is contemplated that the present invention would also be useful with styrofoam cups having widened mouth portions 5' and where the releasable retaining means 20' formed in a plastic cover would comprise a slot having a slightly constricted inlet which would engage with the rim 5' of the styrofoam cup. The individual and separate releasable retaining means for each free side of cover sections 11–13 would comprise one of the slots. The only difference in operation between a cover having the releasable retaining means 20 and a cover having the releasable retaining means 20', is that in the latter, the side portions 12 and 13 must first be lifted before the cover can be slid between the positions shown in FIGS. 4 and 5 otherwise, the covers would operate similarly.

Figure 7:
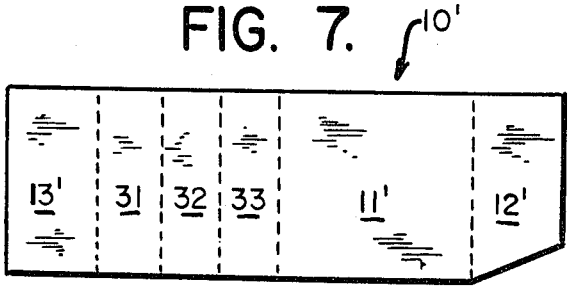
FIG. 7 shows the top view of a further embodiment of the present invention.
Figure 8:
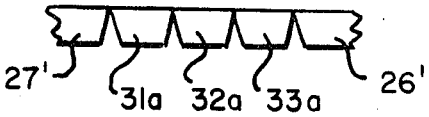
FIG. 8 is a partial side view of the cover of FIG. 7.

FIGS. 7–8 show a universal cover 10' having extensions for greater length so as to be usable with different size cups. The cover 10' has intermediate section 11' and end sections 12' and 13' which are constructed as shown in FIGS. 2 and 3*a*–*d*. Third extension sections 31, 32 33 are disposed between sections 11' and 13' and have releasable retaining means 31*a*, 32*a*, 33*a* on one side adjacent lips 26', 27' and 31*b*, 32*b*, 33*b* (not shown) on the other side.

It will be appreciated that the instant specification and claims are set forth by way of illustration and not limitation, and that various modifications and changes may be made without departing from the spirit and scope of the present invention.

What is claimed is:

1. In combination: a drinking cup having walls forming a substantially rectangular open top mouth; and a cover for the cup comprising means for releasably retaining the cover on the mouth of the cup and for permitting sliding movement of the cover parallel to two parallel sides of the mouth and between first and second extreme positions, wherein the cover has means for completely closing the mouth of the cup when the cover is in the first position and opening means forming a pouring aperature at the mouth of the cup when the cover is in the second position, said opening means extending beyond said cup walls when said cover is in said first position.

2. The combination according to claim 1, wherein the cover comprises a rectangular intermediate covering section and first and second sections connected to the sides of the intermediate section perpendicular to the direction of movement, wherein the first end section is rectangular and the second end section has a cut out at the periphery thereof, wherein the intermediate and first sections are configured to overlie the mouth of the cup when the cover is in the first position to comprise the means for completely closing the mouth of the cup and the intermediate and second sections are configured to overlie the mouth of the cup when the cover is in the second position to comprise with the cut out, the means forming the pouring aperture at the mouth of the cup.

3. The combination according to claim 2, wherein the second section has a trapezoidal configuration.

4. The combination according to claim 2, further comprising at least one third section connected between the first end section and the intermediate section.

5. In combination: a cup having means forming a substantially rectangular mouth; and a cover for the cup comprising means for releasably retaining the cover on the mouth of the cup and for permitting sliding movement of the cover parallel to two parallel sides of the mouth and between first and second extreme positions, wherein the cover has means for completely closing the mouth of the cup when the cover is in the first position and means forming a pouring aperture at the mouth of the cup when the cover is in the second position, said cover comprising a rectangular intermediate covering section and first and second sections connected to the sides of the intermediate section perpendicular to the direction of movement, wherein the first end section is rectangular and the second end section has a cut out at the periphery thereof, wherein the intermediate and first sections are configured to overlie the cup when the cover is in the first position to comprise the means for completely closing the mouth of the cup and the intermediate and second sections are configured to overlie the mouth of the cup when the cover is in the second position to comprise with the cut out, the means forming the pouring aperture at the mouth of the cup, and wherein the first, second and intermediate sections are substantially planar and hingedly connected together, to enable the lifting of the end sections in the first and second positions without lifting the intermediate section.

6. The combination according to claim 2 or 5, wherein the cover comprises an integral member of deformable rigid material.

7. The combination according to claim 6, wherein the cover is constituted of plastic.

8. The combination of claim 6, wherein the cover is constituted of cardboard.

9. The combination according to claim 2 or 5, wherein the mouth of the cup has a widened rim around the edge thereof and the releasable retaining means comprises a separate lip for each free side of each section except at the cut out in the second section, wherein each lip depends downwardly from each side and extends inwardly to engage the underside of the rim.

10. The combination according to claim 2 or 5, wherein the mouth of the cup has a widened rim at the edge thereof and the releasable retaining means comprises a slot at each free side of each section except at the cut out in the second section, wherein each slot is receptive of a portion of the edge of the mouth and is configured to engage with the rim.

11. The combination according to claim 1, wherein the cup has a circular base.

12. A cover for a rectangular mouth drinking cup, the cup having walls, and an open top bounded by said walls, the cover comprising: means for releasably retaining the cover on mouth of the cup and for permitting sliding movement of the cover parallel to two parallel sides of the mouth and between first and second extreme positions, wherein the cover has means for completely closing the mouth of the cup when the cover is in the first position and opening means forming a pouring aperture at the mouth of the cup when the cover is in the second position, and wherein said opening means extends beyond said open top when said cover is in said first position.

* * * * *